US007587911B2

(12) United States Patent
Yanik et al.

(10) Patent No.: US 7,587,911 B2
(45) Date of Patent: Sep. 15, 2009

(54) COMPACT EVAPORATOR FOR CHILLER APPLICATION

(75) Inventors: Mustafa Kemal Yanik, York, PA (US); Satheesh Kulankara, York, PA (US); Mahesh Valiya Naduvath, Lutherville, MD (US); John Raymond Mathias, Basildon (GB)

(73) Assignee: York International Corporation, York, PA (US)

( * ) Notice: Subject to any disclaimer, the term of this patent is extended or adjusted under 35 U.S.C. 154(b) by 0 days.

(21) Appl. No.: 12/018,321

(22) Filed: Jan. 23, 2008

(65) Prior Publication Data

US 2008/0110202 A1 May 15, 2008

Related U.S. Application Data

(63) Continuation of application No. 11/271,764, filed on Nov. 10, 2005, now Pat. No. 7,337,630.

(51) Int. Cl.
*F25D 39/02* (2006.01)

(52) U.S. Cl. ..... 62/515; 62/434

(58) Field of Classification Search ..... 62/515, 62/434, 335, 74; 165/135
See application file for complete search history.

(56) References Cited

U.S. PATENT DOCUMENTS

| | | | | |
|---|---|---|---|---|
| 4,061,184 | A | 12/1977 | Radcliffe | |
| 4,089,368 | A | 5/1978 | Bell, Jr. et al. | |
| 4,402,361 | A | 9/1983 | Dominguez | |
| 4,616,487 | A | 10/1986 | Franklin | |
| 4,926,659 | A | 5/1990 | Christensen et al. | |
| 5,193,353 | A | 3/1993 | Brendel et al. | |
| 5,241,839 | A * | 9/1993 | Hughes | 62/515 |
| 5,333,677 | A | 8/1994 | Molivadas | |
| 5,435,155 | A * | 7/1995 | Paradis | 62/515 |
| 5,695,004 | A | 12/1997 | Beckwith | |
| 5,701,751 | A | 12/1997 | Flores | |
| 6,205,795 | B1 | 3/2001 | Beckman et al. | |
| 6,516,627 | B2 | 2/2003 | Ring et al. | |
| 6,868,695 | B1 * | 3/2005 | Dingel et al. | 62/515 |
| 7,059,143 | B1 | 6/2006 | Zugibe et al. | |
| 2003/0000245 | A1 | 1/2003 | Guckin | |

FOREIGN PATENT DOCUMENTS

| | | |
|---|---|---|
| EP | 0067799 | 12/1982 |
| JP | 2000304369 | 2/2000 |
| JP | 2001153484 | 8/2001 |

OTHER PUBLICATIONS

YAES-SA QPAK-sa Sonata Air Cooled Screw Chiller R134a Refrigerant Cooling Capacities 705kW to 1282kW.

* cited by examiner

*Primary Examiner*—Melvin Jones
(74) *Attorney, Agent, or Firm*—McNees Wallace & Nurick, LLC

(57) ABSTRACT

An evaporator including a shell having a first end and a second end. A plurality of tubes are disposed within the shell to circulate refrigerant through the shell. A plurality of shell inlets are in fluid communication with the shell to deliver a fluid to exchange heat in the plurality of tubes, preferably through a baffle arrangement. At least one of the shell inlets may be arranged to deliver fluid to the shell adjacent to the first end. In addition, at least one of the other shell inlets may be arranged to deliver fluid adjacent to the second end. A shell outlet is in fluid communication with the shell to discharge fluid from the shell. The shell outlet is arranged to receive the combined liquid delivered to the shell by the plurality of shell inlets.

24 Claims, 10 Drawing Sheets

COMPACT EVAPORATOR FOR CHILLER APPLICATION

CROSS-REFERENCE TO RELATED APPLICATIONS

This patent application is a continuation of U.S. Utility application Ser. No. 11/271,764, filed on Nov. 10, 2005, allowed, entitled "Compact Evaporator for Chiller Application", the disclosure of which is incorporated as if fully rewritten herein.

FIELD OF THE INVENTION

The present invention relates generally to heating, ventilation, air conditioning and refrigeration (HVAC&R) systems. In particular, the present invention relates to HVAC&R systems that utilize a chilled water system.

BACKGROUND OF THE INVENTION

One type of heating ventilation and air conditioning (HVAC&R) system uses a chilled fluid to remove heat from a building and is typically referred to as a chilled water system. The fluid utilized in the chilled water system is not limited to water and may include liquids, such as glycol or brine. In this type of system, a chilled fluid is provided to a building having a heating load. The chilled fluid is placed in a heat exchange relationship with the heating load from the building, usually warm air. During the heat exchange with the heating load, the chilled fluid receives heat from the heating load and generally increases in temperature. In order to remove the heat from the fluid and to lower the temperature of the fluid, a closed loop refrigeration system is utilized. The fluid circulated through the building is chilled by placing the fluid in a heat exchange relationship with another cooler fluid, usually a refrigerant, in a heat exchanger, commonly referred to as an evaporator or chiller. The refrigerant in the evaporator removes heat from the fluid during the evaporation process, thereby cooling the fluid. The chilled fluid is then circulated back to the building for subsequent heat exchanging with the heating load, and the cycle repeats.

Chillers may include a shell and tube heat exchanger design. The shell and tube heat exchanger may include a bundle of heat exchange tubes located in a shell. The tubes are typically fabricated from a metal, such as copper, and may be horizontally mounted. At either end of the tubes are tube sheets that support the individual tubes. Refrigerant may flow through the tubes in order to cool a fluid, usually water or an aqueous solution, flowing through the shell. The use of this type of shell and tube heat exchanger design in an evaporator is commonly referred to as a direct expansion (DX) evaporator. A typical design for DX evaporators includes a single inlet connection and a single outlet connection for the fluid flowing through the shell. The single inlet and single outlet provide a single flow stream of fluid that exchanges heat with the refrigerant flowing inside the tubes. The shell side flow of the fluid follows a serpentine path due to the use of a plurality of baffles inside the shell on the shell side. The shell side fluid flow is generally in one direction providing uneven heat exchange over the length of the shell. Furthermore, DX evaporators incorporating tubes for multiple refrigerant circuits must flow the refrigerant in a single, concurrent direction. For a given shell side fluid flow, the DX evaporators effectiveness depends upon the direction of the refrigerant flow. Known evaporators provide efficient operation and superheated refrigerant by exchanging heat between the outlet flow of refrigerant and the inlet flow of fluid, i.e., by having the shell side fluid flow be opposite the refrigerant flow. The inlet flow of fluid contains an amount of heat greater than the outlet flow of fluid. Therefore, in order to operate efficiently, known DX evaporators must flow the shell side fluid in a single direction in order to efficiently provide heat to the refrigerant outlet.

The refrigerant in the tubes may make multiple passes across the shell through the use of baffling in the headers of the evaporator. However, known DX evaporators utilized in chilled water systems suffer from the drawback that the diameter of the shell of the evaporator becomes relatively large as the total heat exchange capacity increases and the shell requires a larger vertical clearance (i.e., heat exchanger height) in which to install. In particular, known DX evaporators having multiple passes require a large vertical clearance in the chiller platform providing for increased difficulty in installation. In addition, water flowing into the shell through the single inlet could cause excessive tube vibration, which could eventually cause failure of the tubes due to fatigue.

What is needed is an evaporator that permits refrigerant flow in either direction through the tubes, has a relatively small shell diameter, and a reduced tube vibration.

SUMMARY OF THE INVENTION

The present invention is directed to an evaporator including a shell having a first end and a second end. A plurality of tubes are disposed within the shell to circulate refrigerant through the shell. A plurality of shell inlets are in fluid communication with the shell to deliver a fluid to exchange heat in the plurality of tubes, preferably through a baffle arrangement. At least one of the shell inlets may be arranged to deliver fluid to the shell adjacent to the first end. In addition, at least one of the shell inlets may be arranged to deliver fluid adjacent to the second end. A shell outlet is in fluid communication with the shell to discharge fluid from the shell. The shell outlet is arranged to receive the combined liquid delivered to the shell by the plurality of shell inlets.

In another embodiment, the present invention includes a chilled water system having a refrigerant loop and a cooling loop. The refrigerant loop includes a compressor, a condenser, an expansion device and an evaporator connected in a closed loop. At least three openings are present in the shell and are arranged and disposed to deliver fluid to and from the shell. The cooling loop includes at least one second heat exchanger in fluid communication with the evaporator. A fluid is circulated between the evaporator and at least one second heat exchanger. The evaporator is configured to place the fluid and the refrigerant in a heat exchange relationship.

An advantage of the present invention is that the split fluid flow on the shell side results in relatively lower shell side pressure drop across the evaporator.

Another advantage of the present invention is that the split fluid flow on the shell side results in a reduced quantity of cross-flow over the tubes, thereby reducing flow induced tube vibration. Reduced tube vibrations, reduces noise and material fatigue in the tubes.

Still another advantage of the present invention is that the shell diameter may be smaller than conventional evaporator shell designs while providing an almost identical capacity to that of larger diameter, conventional evaporators. This permits easier installation of the chiller system due to the smaller profile of the evaporator.

A further advantage of the present invention is that the performance of the evaporator is substantially unaffected by direction of refrigerant flow due to the split flow of fluid on the shell side. In addition, the performance, including capacity, efficiency and evaporating temperature, of the evaporator is substantially unaffected in embodiments where refrigerant in some circuits flow in one direction, while refrigerant in other circuits flow in the opposite direction. Because the evaporator performance is independent of refrigerant flow direction, a chiller system utilizing the present invention could have refrigerant circuits with refrigerant flowing in the same or different directions relative to each other.

Another advantage of the present invention is that the evaporator of the present invention includes a smaller number of tubes than an evaporator having a single inlet and a single outlet, simplifying the manufacture and assembly of the evaporator.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
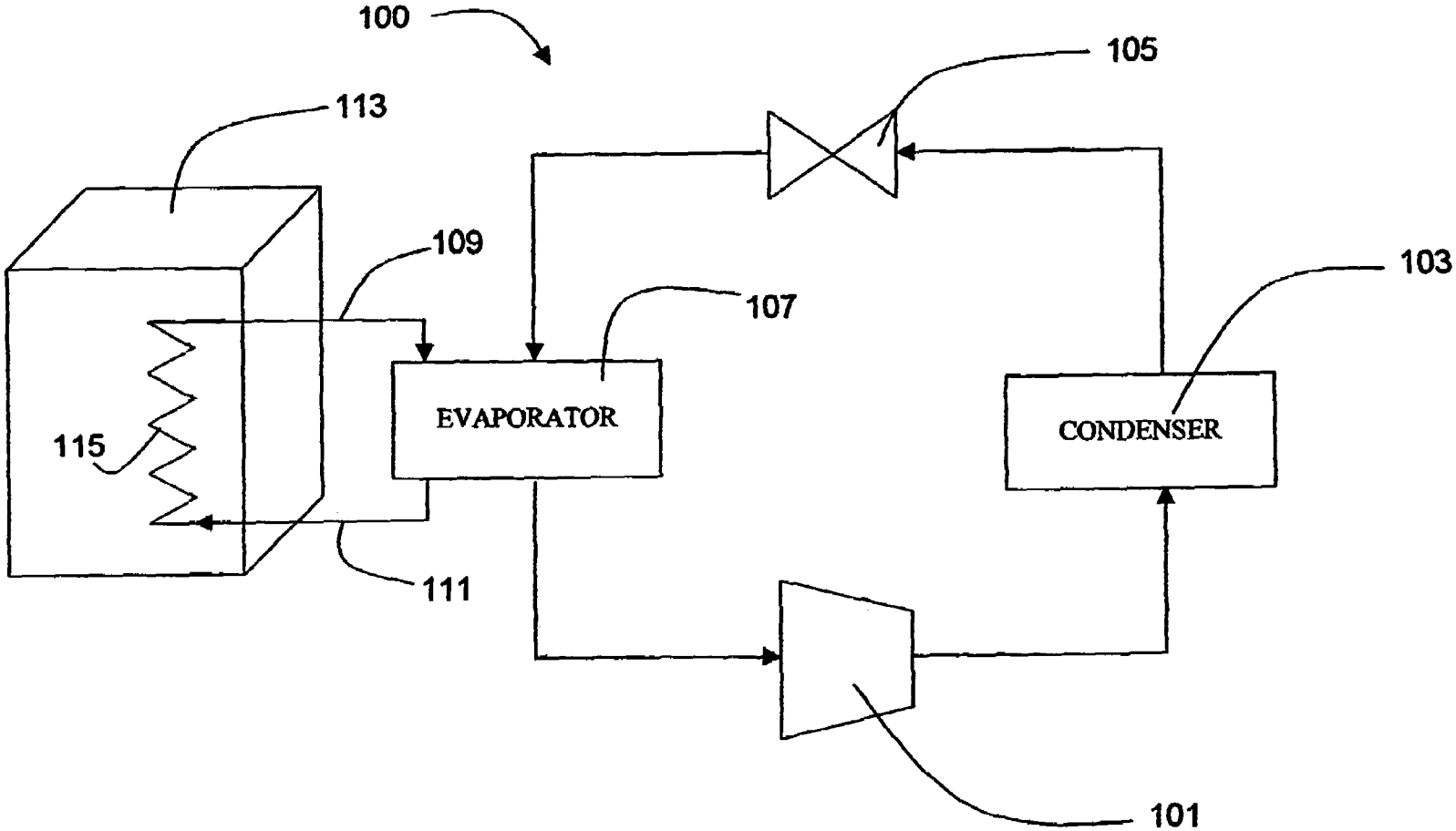
FIG. 1 shows a schematic view of a chilled water system.

The present invention may be utilized with an HVAC system such as a chilled water system. A suitable system for use with the present invention is illustrated, by means of example, in FIG. 1. As shown, the chilled water system 100 utilizes a refrigeration cycle or circuit, including a compressor 101, a condenser 103 and evaporator 107. In addition, the chilled water system 100 further includes a cooling loop or circuit, or secondary coolant loop or circuit, including evaporator 107 and one or more heat exchangers 115. The HVAC or refrigeration system according to the present invention may include many other features that are not shown in FIG. 1. The features not shown have been purposely omitted to simplify the drawing for ease of illustration.

During operation of the chilled water system 100, the compressor 101 compresses a refrigerant vapor and delivers it to the condenser 103. The compressor 101 may be any suitable type of compressor including, but not limited to, reciprocating compressors, scroll compressors, screw compressors, centrifugal compressors and rotary compressors. The refrigerant vapor delivered by the compressor 101 to the condenser 103, which transfers heat from the refrigerant to a medium, such as air or water, undergoes a phase change to a refrigerant liquid as a result of the heat exchange with the medium. The condensed liquid refrigerant from condenser 103 flows though an expansion device 105, which reduces the pressure of the refrigerant. The lower pressure refrigerant is then delivered to the evaporator 107 that evaporates the lower pressure refrigerant to a vapor. The evaporating refrigerant in the evaporator 107 enters into a heat exchange relationship with a fluid to remove heat from the fluid. The vaporous refrigerant exits the evaporator 107 and returns to the compressor 101 by a suction line of the compressor 101 to complete the cycle. It is to be understood that any suitable configuration of condenser 103 may be used in the system 100, provided that the appropriate phase change of the refrigerant in the condenser 103 is obtained. Chilled water systems utilize the heat exchange in the evaporator 107 in order to cool a fluid, which is utilized to provide cooling to a heat load 113 (e.g., building, structure or other heat source). Chilled water systems are not limited to water, but may include any suitable fluid capable of transferring an amount of heat from a heat load to an evaporator 107. Suitable fluids for use in the chilled water system include, but are not limited to, liquids, such as water, glycol or brine. In the cooling loop, warm fluid 109 returns from heat exchanger(s) 115 within heat load 113 and enters the evaporator 107. The warm fluid then exchanges heat with the evaporating refrigerant. The evaporator 107 cools the fluid and the cool fluid 111 returns to the heat load 113. The heat load 113 may be any application requiring cooling, including a building or a structure. In addition, heat exchanger 115 may be any suitable heat exchange device that is capable of exchanging heat from the heat load to the fluid circulating in the cooling loop. The cool fluid 111 exchanges heat with the heat load 113 via heat exchanger(s) 115 and returns as warm fluid 109 to repeat the cycle.

Figure 2A:
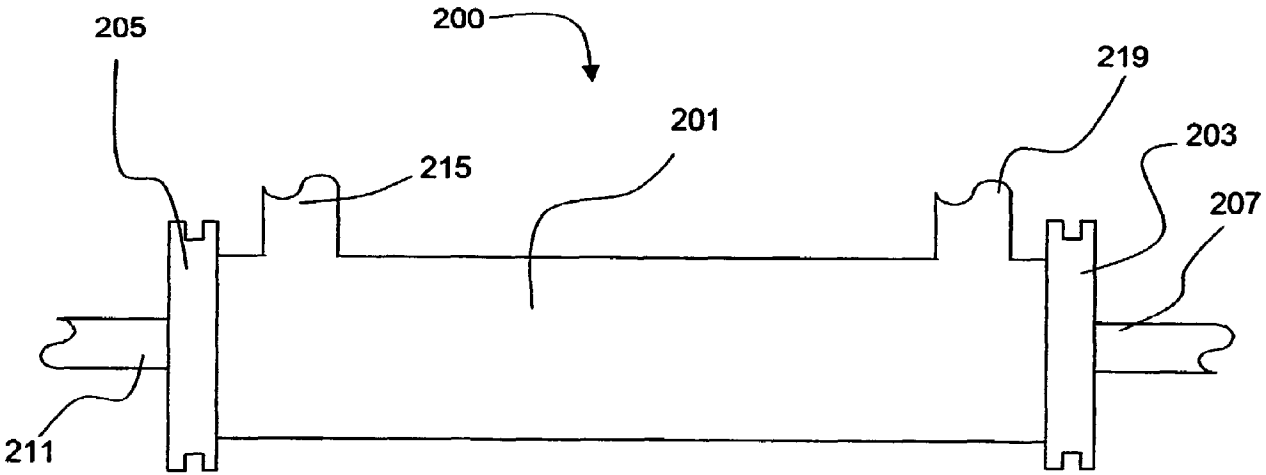
FIG. 2A (Prior Art)
FIG. 2A shows a top view of a prior art evaporator.
Figure 2B:
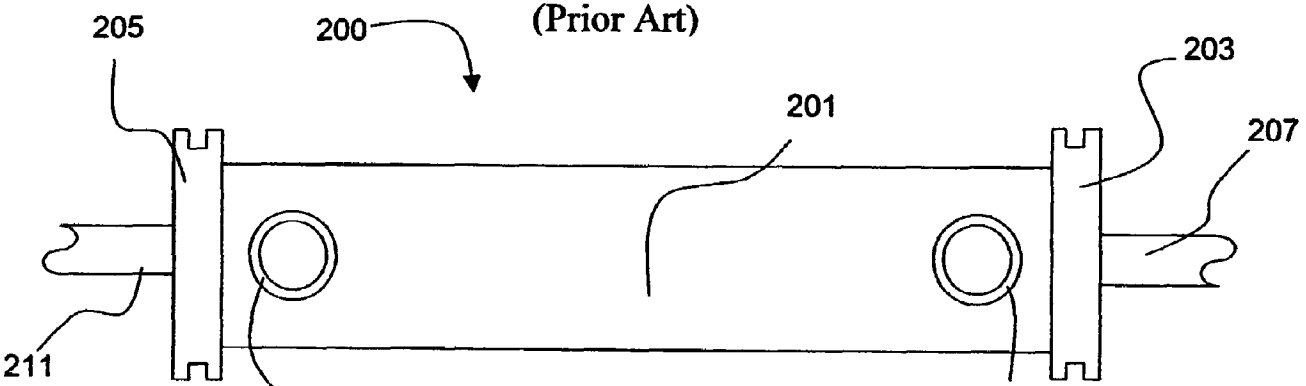
FIG. 2B (Prior Art)
FIG. 2B shows a front view of a prior art evaporator.

FIGS. 2A and 2B show schematic views of a known evaporator 200. FIG. 2A shows a schematic top view of the known evaporator 200 and FIG. 2B shows a schematic front view of the known evaporator 200. The evaporator 200 includes a shell extending between a first header 203 and a second header 205. A refrigerant inlet 207 is in fluid communication with the first header 203 and is arranged to provide refrigerant to the first header 203. The first header 203 is in fluid communication with tubes (not shown) arranged within the shell 201. Refrigerant flowing into the tubes from the first header 203 flows through the tubes along the length of the shell 201 and is delivered to the second header 205. The second header 205 is in fluid communication with an outlet 211. The shell 201 includes fluid inlet 215. The fluid enters the shell 201 at fluid inlet 215 and exchanges heat with the refrigerant in the tubes located in the shell 201. The fluid then exits through fluid outlet 219. In a chilled water system building cooling application, the fluid is then transported to a heating load in order to cool, for example, a building or other structure prior to the refrigerant leaving the evaporator 200 via refrigerant outlet 211, the refrigerant exchanges heat with the fluid entering the shell 201 via fluid inlet 215. The fluid entering the shell 201 has an amount of heat greater than the fluid exiting the shell 201. The heat exchange with the fluid entering the shell 201 allows the refrigerant to receive a maximum amount of heat from the fluid stream, thereby allowing the refrigerant to be superheated by the fluid entering the shell 201.

Figure 3A:
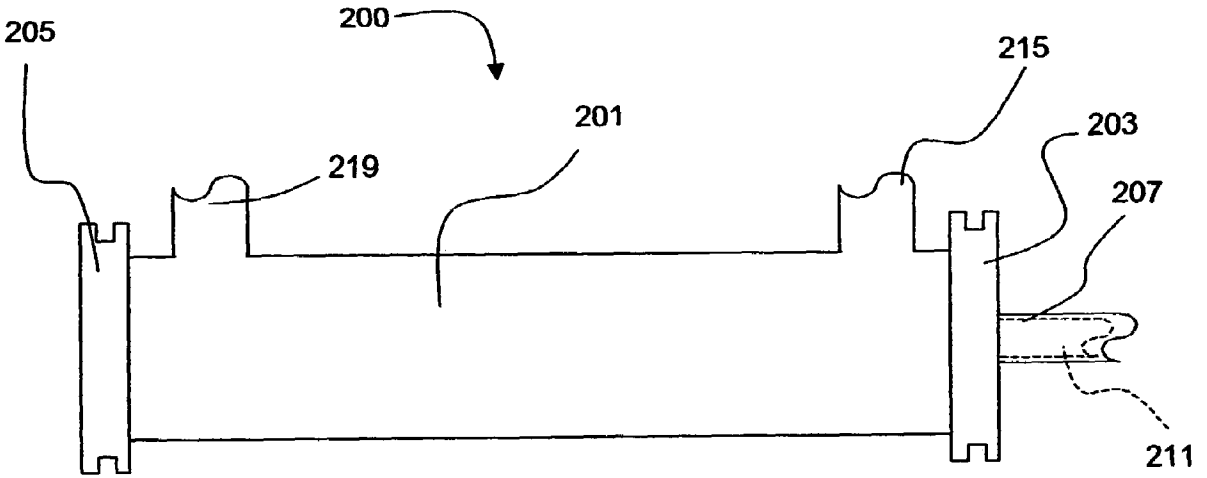
FIG. 3A (Prior Art)
FIG. 3A shows a top view of an alternate prior art evaporator.
Figure 3B:
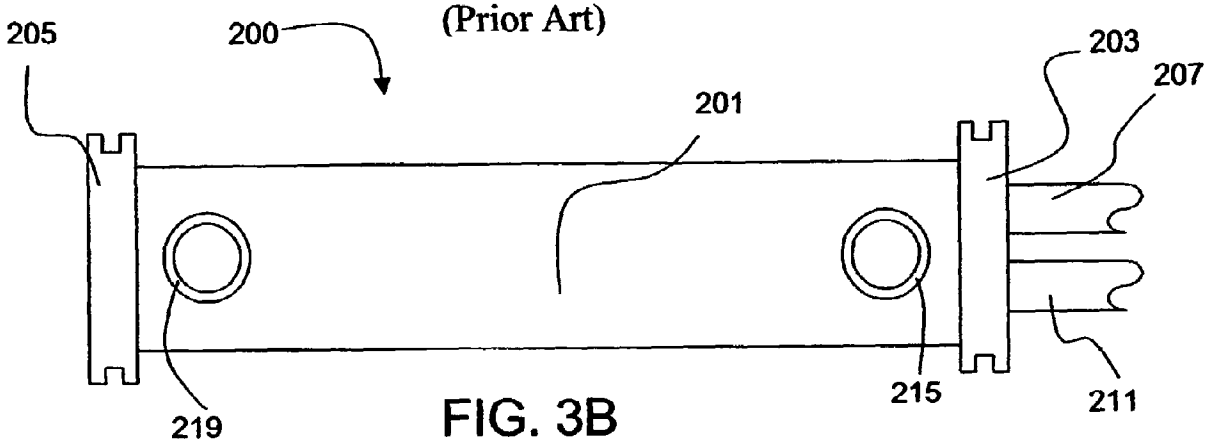
FIG. 3B (Prior Art)
FIG. 3B shows a front view of an alternate prior art evaporator.

FIGS. 3A and 3B show schematic views of an alternate known evaporator 200. FIG. 3A shows a schematic top view of the known evaporator 200 and FIG. 3B shows a schematic front view of the known evaporator 200. The fluid inlet 215 is arranged substantially adjacent to the first header 203. The fluid outlet is arranged substantially adjacent to the second header 205. Refrigerant inlet 207 and refrigerant outlet 211 are in fluid communication with first header 203. Baffles (not shown in FIGS. 3A and 3B) are utilized in first header 203 and second header 205 in order to direct the refrigerant in two or more passes. Prior to the refrigerant leaving the evaporator 200 via refrigerant outlet 211, the refrigerant exchanges heat with the fluid entering the shell 201 via fluid inlet 215. As discussed above, the fluid entering the shell contains an amount of heat greater than the fluid exiting the shell 201 at the fluid outlet 219. The heat exchange with the warm fluid entering the shell 201 allows the refrigerant to receive a maximum amount of heat from the fluid stream, thereby allowing the refrigerant to be superheated by the fluid entering the shell. Evaporator 200 has a relatively large diameter, making installation in certain applications difficult and subjecting the tubes within shell 201 to substantial cross-flow, thereby causing excessive vibration of the tubes.

Figure 4A:
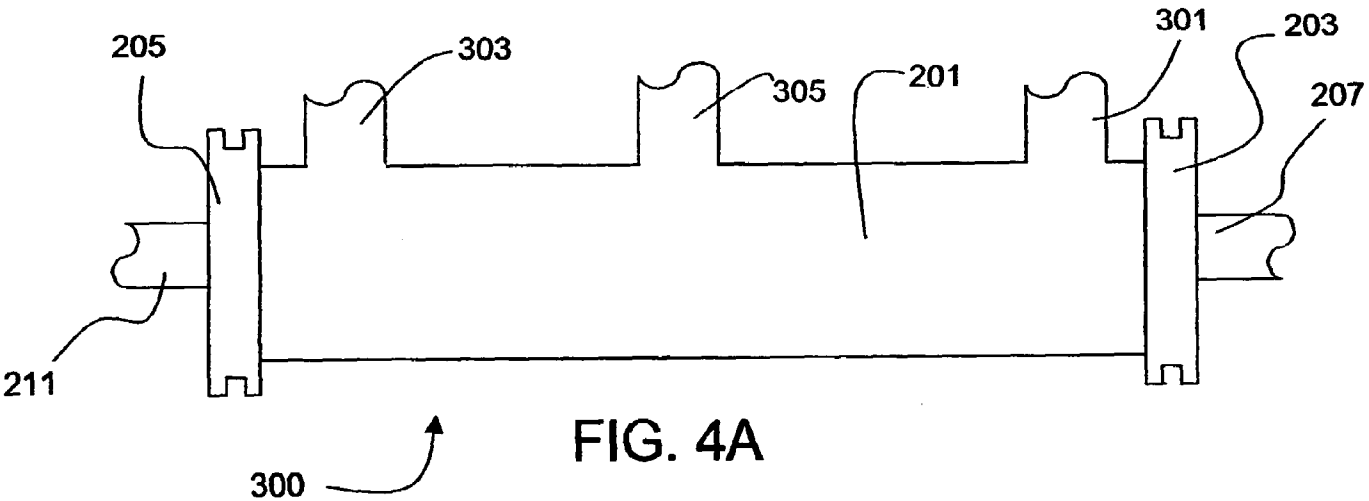
FIG. 4A shows a top view of an evaporator according to an embodiment of the present invention.
Figure 4B:
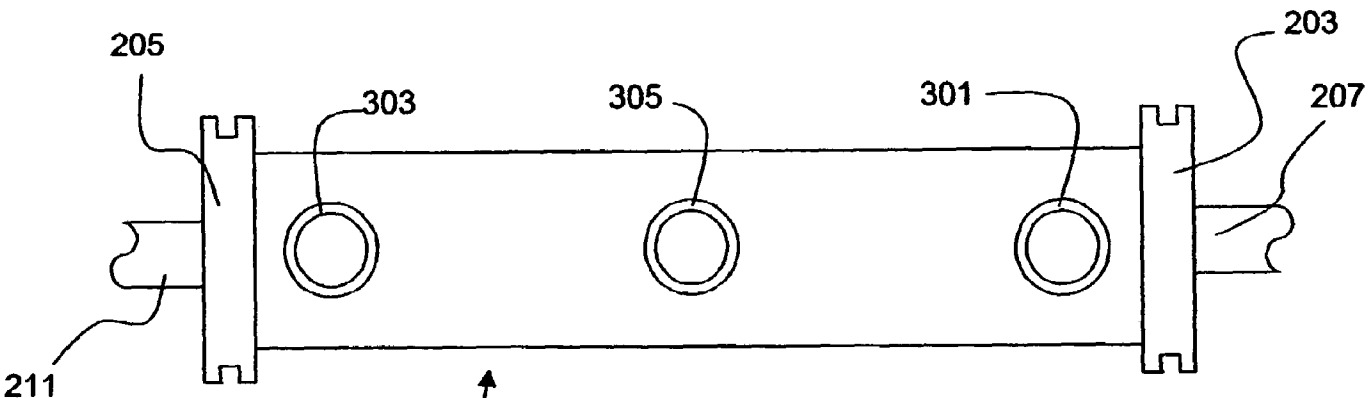
FIG. 4B shows a front view of an evaporator according to an embodiment of the present invention.

FIG. 4A and FIG. 4B show schematic views of an evaporator 300 according to an embodiment of the present invention. FIG. 4A shows a schematic top view of the evaporator 300 and FIG. 4B shows a schematic side view of the evaporator 300. Although FIGS. 4A and 4B are designated as a top and front view, the installation of the evaporator 300 may be in any suitable configuration that provides an appropriate arrangement of refrigerant and fluid flow through the evaporator 300 to transfer heat and provide the advantages of the present invention. The evaporator 300 according to the present invention includes a shell 201 extending for a length between a first header 203 and a second header 205. Refrigerant inlet 207 is in fluid communication with the first header 203 to deliver refrigerant to the first header 203. Refrigerant may travel through the shell 201 and exit the shell through second header 205 and the refrigerant outlet 211. Refrigerant may include any type of refrigerant suitable for use with evaporators having a shell and tube arrangement. Suitable refrigerants include, but are not limited to R-134a, R-22, R-410A, R-407C, Ammonia, carbon dioxide, etc.

The shell 201 of the evaporator 300 includes a first fluid inlet 301 adjacent to the first header 203. The shell 201 also includes a second fluid inlet 303 adjacent to the second header 205. The fluid travels through the shell 201 and exchanges heat with tubes (not shown) in the shell 201. The fluid in the shell 201 then exits through fluid outlet 305. As shown in FIG. 1, the fluid preferably is circulated in a cooling loop between the evaporator 300 and heat exchanger(s) 115. The fluid outlet flow includes the combined fluid inlet flows from the first fluid inlet 301 and the second fluid inlet 303.

Figure 5:
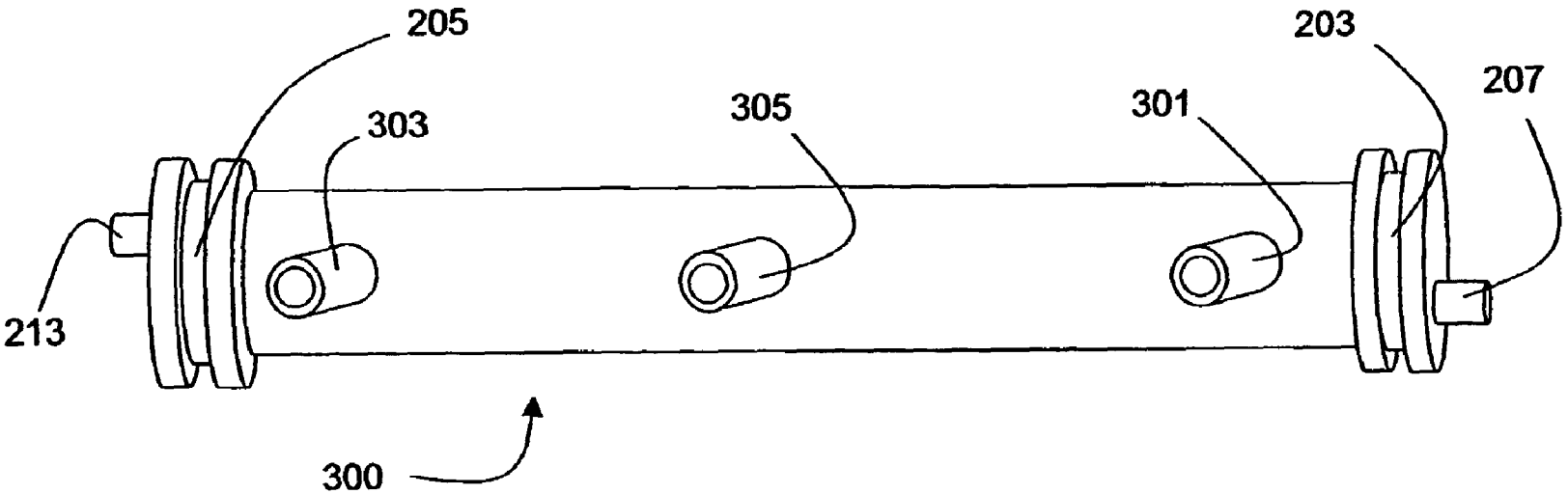
FIG. 5 shows a perspective view of an evaporator according to an embodiment of the present invention.

FIG. 5 shows a perspective side view of an evaporator 300 according to an embodiment of the present invention. As shown in FIGS. 4A and 4B, the evaporator 300 includes a substantially cylindrical shell 201. Refrigerant inlet 207 and refrigerant outlet 213 include substantially cylindrical piping in fluid communication with the first header 203 and second header 205, respectively. The shell 201 also has substantially cylindrical first fluid inlet 301, second fluid inlet 303 and fluid outlet 305. The evaporator 300 is not limited to the geometry shown in FIG. 5. The evaporator 300 may be provided in any suitable geometry for the shell 201, the fluid inlets 301 and 303, the fluid outlet 305 and the refrigerant inlets 207 and 213 that provide the refrigerant flow and fluid flow such that heat transfer may take place.

Figure 6:
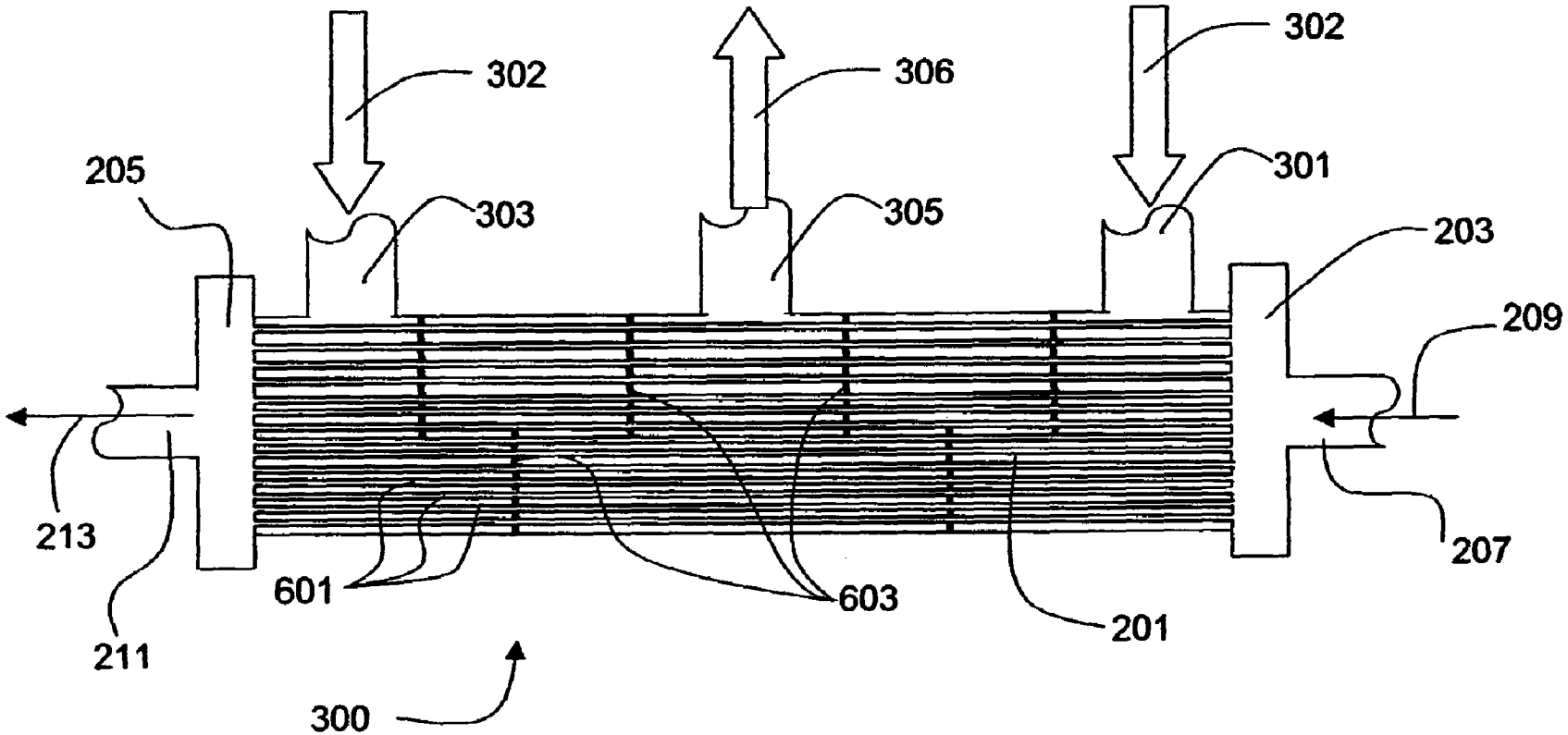
FIG. 6 shows a cutaway view of an evaporator according to an embodiment of the present invention

FIG. 6 shows a cutaway view of an evaporator 300 according to an embodiment of the present invention. FIG. 6 shows an inlet refrigerant flow 209 entering the first header 203 via the refrigerant inlet 207. The refrigerant entering the first header 203 is distributed to the tubes 601 and is transported through the tubes 601 to the second header 205. From the second header 205, outlet refrigerant flow 213 is discharged from the refrigerant outlet 211. The first header 203 and second header 205 are not limited to the configuration shown, the first and second headers 203 and 205 may be any refrigerant distribution device that is capable of delivering refrigerant to the tubes 601 within the shell 201. As discussed above, the refrigerant may also flow in the opposite direction, wherein the refrigerant is delivered to the second header 205 via refrigerant outlet 211 and travels from the second header 205, through the tubes 601, and into the first header 203, wherein the refrigerant inlet 207 discharges the refrigerant from the evaporator 300. The rate of heat transfer between the refrigerant and the fluid, the efficiency of heat exchange, and the capacity is approximately the same whether the refrigerant flows from the first header 203 to second header 205 or the refrigerant flows from second header 205 to first header 203, thereby permitting the refrigerant flow to be reversed without any substantial reduction in evaporator 300 performance. As shown in FIGS. 4A and 4B, shell 201 of the evaporator 300 includes a first fluid inlet 301 adjacent to the first header 203. The shell 201 also includes a second fluid inlet 303 adjacent to the second header 205. The fluid travels through the shell 201 and exchanges heat with tubes 601 disposed in the shell 201. Baffles 603 may be included in shell 201 to direct fluid over tubes 601 and to fluid outlet 305. Baffles 603 are not limited to the configuration shown in FIGS. 6-8 and may be arranged in any suitable configuration that directs the flow of fluid through the shell 201 and supports tubes 601. The combined fluid entering the shell 201 from the first fluid inlet 301 and the second fluid inlet 303 then exits through fluid outlet 305. Fluid outlet flow 306 includes the combined fluid inlet flows 302 from the first fluid inlet 301 and the second fluid inlet 303.

Figure 7:
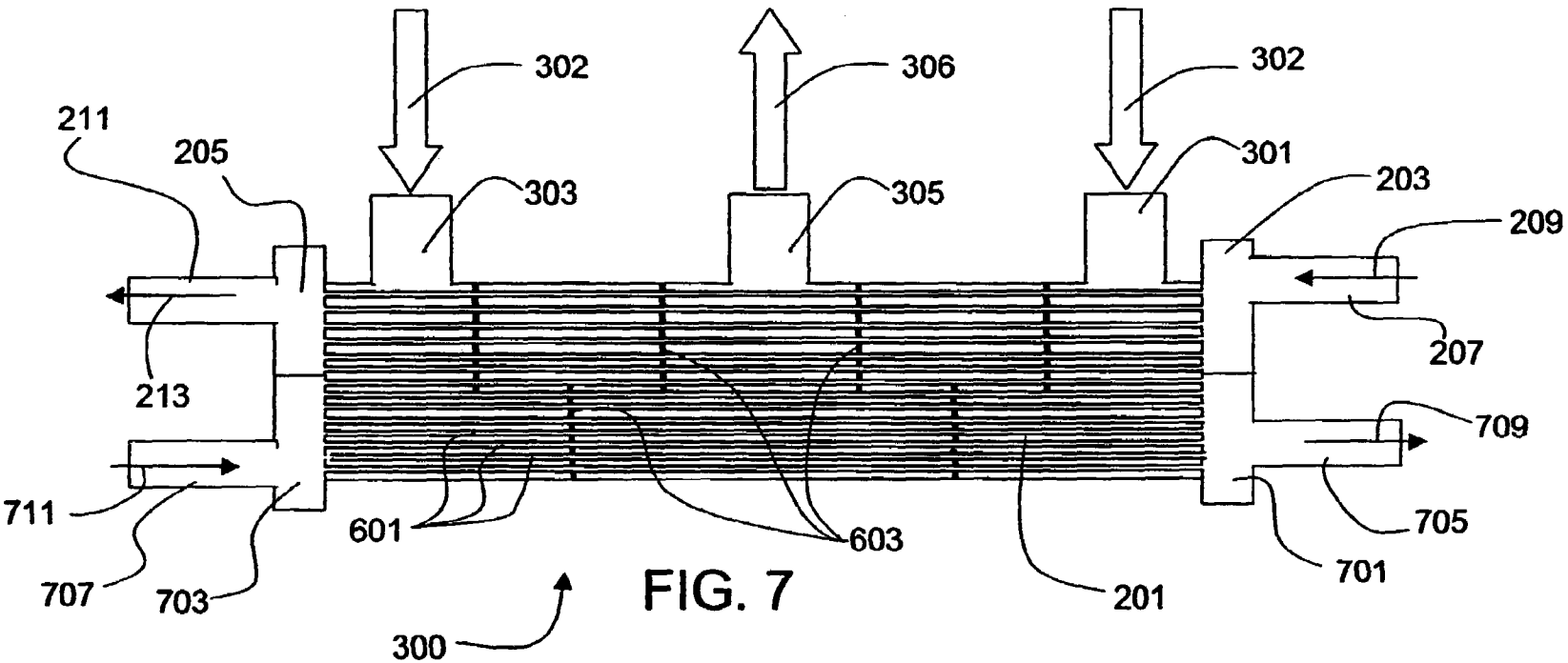
FIG. 7 shows a cutaway view of an evaporator according to another embodiment of the present invention.

FIG. 7 shows a cutaway view of an evaporator 300 according to another embodiment of the present invention. FIG. 7 shows an evaporator 300 with multiple independent refrigerant circuits. The multiple independent refrigerant circuits are preferably refrigerant circuits that each include, in addition to the evaporator 300, a compressor, a condenser arrangement and an expansion device. The evaporator 300 includes a first circuit that is configured substantially as shown and described with respect to FIG. 6, including the refrigerant inlet flow 209, the refrigerant inlet 207, the first header 203, the second header 205, the refrigerant outlet 211 and the outlet refrigerant flow 213. In addition, the evaporator 300 shown in FIG. 7 includes a first fluid inlet 301, a second fluid inlet 303, a fluid outlet 305, an inlet fluid flow 302 and an outlet fluid flow 306 that are arranged substantially as shown an described with respect to FIG. 6. However, FIG. 7 includes a second refrigerant circuit including a second circuit inlet 707, which receives a second refrigerant inlet flow 711 that is delivered to the second circuit second header 703. The second circuit second header 703 is in fluid communication with tubes 601. The refrigerant travels through tubes 601 to the second circuit first header 701. The refrigerant is discharged from the second circuit first header 701 via second circuit outlet 705 as second refrigerant outlet flow 709. In the arrangement shown in FIG. 7, the flow of refrigerant in the first circuit and the flow of refrigerant in the second circuit is countercurrent; however, the flow arrangement is not limited to being countercurrent. The flow in the first and second circuit may be concurrent, countercurrent or any combination of concurrent and countercurrent. In addition, the present invention is not limited to two circuits. A plurality of independent circuits may be utilized and may include circuits having varying heat transfer requirements.

Figure 8:
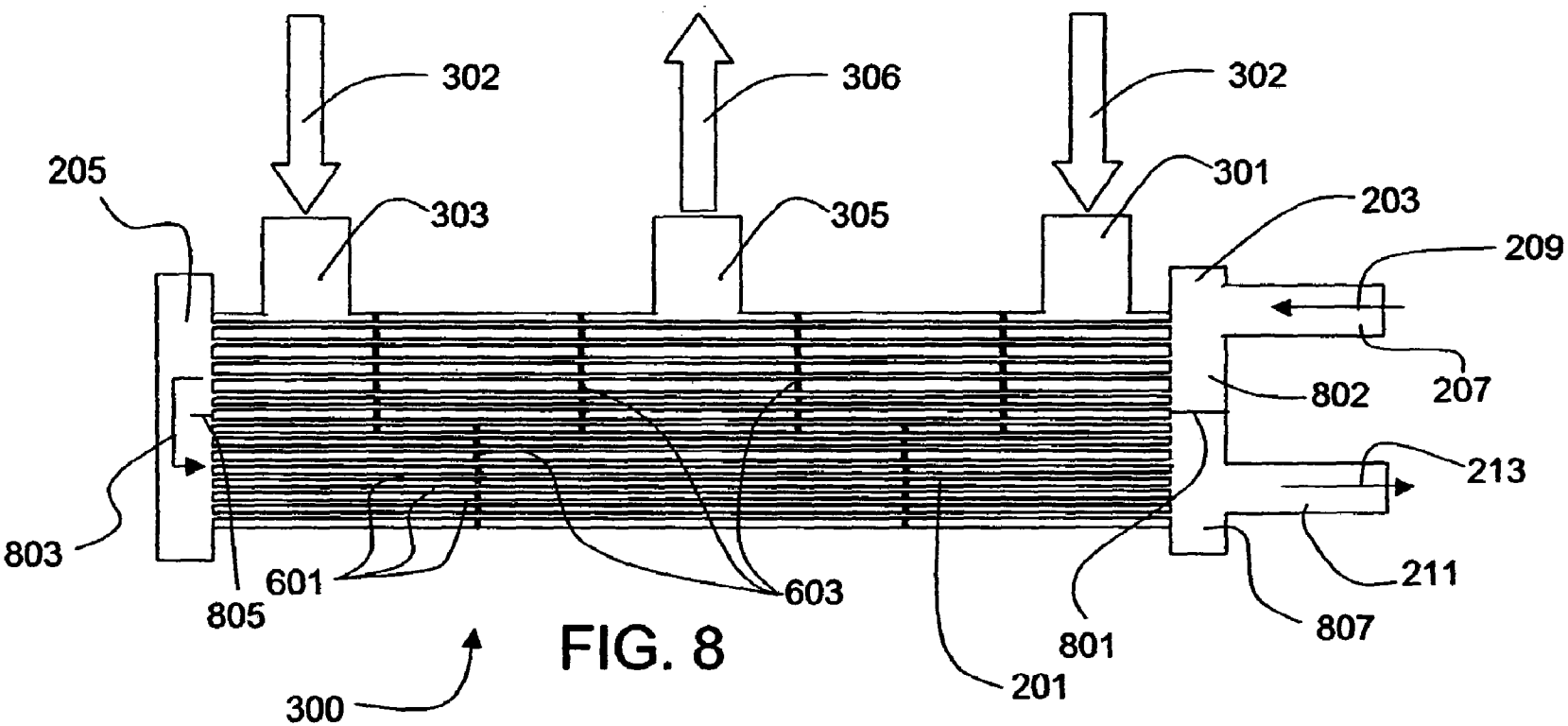
FIG. 8 shows a cutaway view of an evaporator according to still another embodiment of the present invention

FIG. 8 shows a cutaway view of an evaporator 300 according to another embodiment of the present invention. FIG. 8 shows an evaporator 300 according to the present invention wherein the refrigerant travels in multiple passes through the shell 201. The evaporator 300 includes a dual refrigerant pass arrangement, including the refrigerant inlet flow 209, the refrigerant inlet 207, the first header 203, the second header 205, the refrigerant outlet 211 and the outlet refrigerant flow 213. In addition, the evaporator 300 shown in FIG. 8 includes a first fluid inlet 301, a second fluid inlet 303, a fluid outlet 305, an inlet fluid flow 302 and an outlet fluid flow 306 that are arranged substantially as shown and described with respect to FIG. 6. However, in FIG. 8, the refrigerant inlet 207 is in fluid communication with an upper portion 802 of the first header 203. The first header is divided by baffle 801 into the upper portion 802 and a lower portion 807. The baffle 801 divides the first header in order to provide inlet refrigerant flow 209 to only a portion of the tubes 601. The portion of the tubes 601 that receive refrigerant from the upper portion 802 travels through the tubes 601 along the length of the shell 201 in a first pass to the second header 205. The second header 205 preferably includes baffle 805 that directs return refrigerant flow 803 into the tubes 601 to travel countercurrent to the first pass to the lower portion 807 of the first header 203. The lower portion 807 of the first header 203 delivers the refrigerant from the tubes 601 to the refrigerant outlet 211 and is discharged as outlet refrigerant flow 213. Although FIG. 8 shows a dual pass evaporator 300, any number of passes may be utilized. Further, the refrigerant inlets and outlets are not limited to being in fluid communication with a single header. Any combination of refrigerant inlets and outlets may be utilized. In addition, multiple circuits, as shown and described with respect to FIG. 7, may be used in combination with multiple passes.

An advantage of the split flow of fluid in the shell 201 is that the evaporator 300 may include a high ratio of shell length to shell diameter. The shell length is defined as the length of the shell 201 between the first header 203 and the second header 205. The shell diameter is defined as the inner diameter of the shell 201 available for receiving fluid from the fluid inlets 301, 303 and providing fluid to fluid outlet 305. The utilization of the multiple inlets to the shell 201 to divide fluid flow decreases the volume of flow entering the shell at a given shell diameter. Therefore, a reduced diameter may be utilized in the evaporator 300 to maintain substantially identical capacity, efficiency and heat exchange rate as the known evaporator 200 having a single inlet and single outlet shell with a given shell diameter. The reduced diameter provides additional advantages including reduced cross-flow of fluid over the tubes, thereby reducing flow induced tube vibration, and permitting easy installation in areas having reduced clearance. Suitable ratios of the shell length to the shell diameter include from greater than about 5:1, preferably about 5:1 to about 20:1. In one embodiment of the present invention, the ratio of the shell length to the shell diameter includes greater than about 7:1. The high ratio of shell length to shell diameter permits the evaporator 300 to have a reduced height, which permits the installation of the evaporator 300 into chiller platforms having a smaller clearance than can be obtained with conventional heat exchanger systems. The reduction in aspect ratio compared to known heat exchangers may be provided in any arrangement of refrigerant flow, including multiple refrigerant circuits having independent flow directions (e.g., FIG. 7) and multiple pass evaporators (e.g., FIG. 8).

EXAMPLE 1

Example 1 includes a DX evaporator having a 375-ton cooling capacity. Table 1 includes the aspect ratio of a prior art evaporator having a single inlet and a single outlet on the shell-side of the evaporator (see e.g., FIGS. 3A and 3B) in comparison to an evaporator according to an embodiment of the present invention having the same capacity. Aspect ratio is defined as a ratio of the length to the height (i.e., length/height).

TABLE 1

| 375 Ton Evaporator | Diameter [inch] | Length [inch] | Aspect Ratio [/] |
|---|---|---|---|
| Comparative Example 1* | 30 | 103.2 | 3.44 |
| Example 1** | 22 | 186 | 8.45 |

*375 Ton Evaporator arranged as shown in FIGS. 3A and 3B
**375 Ton Evaporator arranged as shown in FIGS. 4A, 4B and 6

EXAMPLE 2

Example 2 includes a DX evaporator having a 500-ton cooling capacity. Table 2 includes the aspect ratio of a prior art evaporator having a single inlet and a single outlet on the shell-side of the evaporator (see e.g., FIGS. 3A and 3B) in comparison to an evaporator according to an embodiment of the present invention having the same capacity.

TABLE 2

| 500 Ton Evaporator | Diameter [inch] | Length [inch] | Aspect Ratio [/] |
|---|---|---|---|
| Comparative Example 2* | 34 | 97.2 | 2.86 |
| Example 1** | 25.5 | 192 | 7.53 |

*500 Ton Evaporator arranged as shown in FIGS. 3A and 3B
**500 Ton Evaporator arranged as shown in FIGS. 4A, 4B and 6

In addition to having the reduced aspect ratio shown in Tables 1 and 2, Examples 1 and 2 also may flow refrigerant from the first header to the second header or from the second header to the first header with little or no reduction in evaporator performance. In addition, the evaporating temperature of the evaporator 300 is maintained regardless of direction of refrigerant flow.

Figure 9:
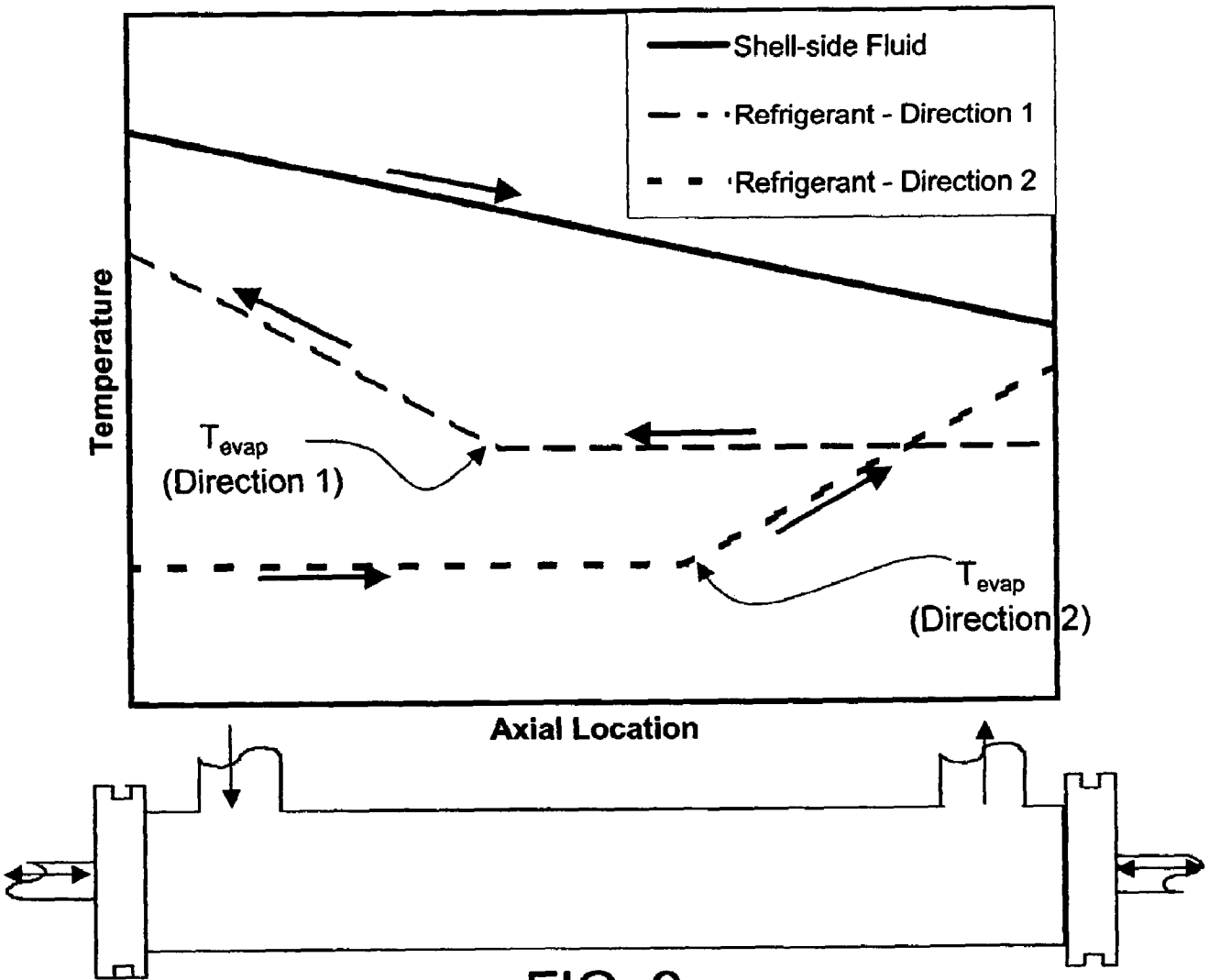
FIG. 9 shows a temperature profile graph over a prior art heat exchanger.

FIG. 9 shows a temperature profile across the length of a prior art evaporator 200 having the arrangement shown in FIGS. 2A and 2B. The axial location is shown as a function of distance across the evaporator, shown schematically below the graph. FIG. 9 shows a substantially linear reduction in fluid temperature on the shell side of the evaporator. When refrigerant is flowing in Direction 1 (i.e., from right to left, as shown in FIG. 9), evaporating temperature ($T_{evap}$) of the evaporator is higher than the $T_{evap}$ of the evaporator when the refrigerant is flowing in Direction 2 (i.e., from left to right, as shown in FIG. 9), wherein the efficiency and capacity of the evaporator are likewise reduced.

Figure 10:
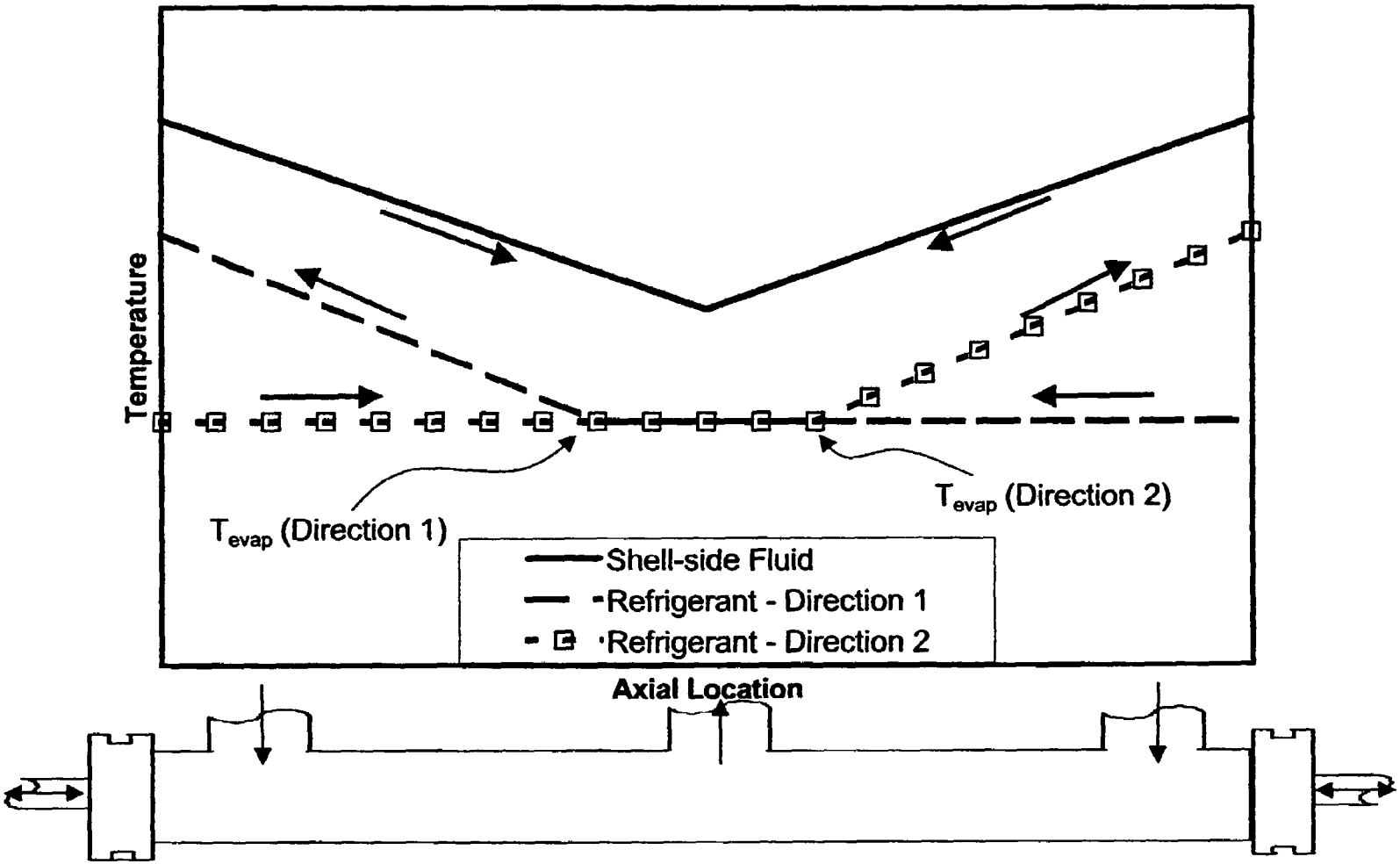
FIG. 10 shows a temperature profile graph over an embodiment of the present invention.

FIG. 10 shows a temperature profile across the length of an evaporator 300 according to an embodiment of the present invention (e.g., FIG. 6). The axial location is shown as a function of location across the evaporator, shown schematically below the graph. The fluid temperature linearly decreases to a center point from each of the fluid inlets 301 and 303. When refrigerant is flowing in Direction 1 (i.e., from right to left, as shown in FIG. 10), the evaporating temperature ($T_{evap}$) of the evaporator is substantially identical to the $T_{evap}$ of the evaporator when the refrigerant is flowing in Direction 2 (i.e., from left to right, as shown in FIG. 10), wherein the efficiency and capacity of the evaporator are likewise substantially identical. As shown in FIG. 10, the $T_{evap}$ of the evaporator 300 according to the present invention is independent of the direction of flow of refrigerant, permitting a variety of possible configurations including multiple refrigerant circuits, multiple passes, reversible refrigerant flows.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. An evaporator for a chilled fluid system comprising:

a shell comprising a first end and a second end;

a plurality of tubes disposed in the shell to circulate refrigerant through the shell;

a plurality of shell inlets in fluid communication with the shell to deliver a fluid to exchange heat with refrigerant in the plurality of tubes, at least one shell inlet being disposed adjacent to the first end and at least one other shell inlet being disposed adjacent to the second end;

a shell outlet in fluid communication with the shell to discharge the fluid from the shell, the shell outlet being arranged and disposed to receive the combined fluid delivered to the shell by the plurality of shell inlets; and one of an evaporating temperature of the evaporator being substantially independent of a direction of refrigerant flow in the plurality of tubes, a cooling capacity of the evaporator being substantially independent of the direction of refrigerant flow in the plurality of tubes, a rate of heat exchange of the evaporator being substantially independent of the direction of refrigerant flow in the plurality of tubes, a ratio of a shell length to a shell inner diameter being greater than about 5:1, or the outlet being disposed substantially at a mid-point between the first end and the second end.

2. The evaporator of claim 1, further comprising:

a first header being arranged and disposed in fluid communication with the tubes, the first header being disposed adjacent to the first end; and a second header being arranged and disposed in fluid communication with the tubes, the second header being disposed adjacent to the second end.

3. The evaporator of claim 2, wherein the first header, second header and the plurality of tubes are arranged to provide multiple refrigerant passes through the shell.

4. The evaporator of claim 2, wherein the first header, second header and the plurality of tubes are arranged to incorporate a plurality of refrigerant circuits.

5. The evaporator of claim 1, wherein the fluid comprises a liquid selected from the group consisting of water, glycol, brine and combinations thereof.

6. The evaporator of claim 1, wherein the evaporating temperature of the evaporator is substantially independent of the direction of refrigerant flow in the plurality of tubes.

7. The evaporator of claim 1, wherein the cooling capacity of the evaporator is substantially independent of the direction of refrigerant flow in the plurality of tubes.

8. The evaporator of claim 1, wherein the rate of heat exchange of the evaporator is substantially independent of the direction of refrigerant flow in the plurality of tubes.

9. The evaporator of claim 1, wherein the ratio of the shell length to the shell inner diameter is greater than about 5:1.

10. The evaporator of claim 9, wherein the ratio of the shell length to the shell inner diameter is greater than about 7:1.

11. The evaporator of claim 1, wherein the shell further comprises at least one baffle arranged and disposed to support the plurality of tubes and to direct fluid flow over the plurality of tubes.

12. The evaporator of claim 1, wherein the outlet is disposed substantially at the mid-point between the first end and the second end.

13. A chilled fluid system comprising:

a compressor, a condenser, an expansion device and an evaporator connected in a closed refrigerant loop;

a cooling loop comprising the evaporator and at least one second heat exchanger in fluid communication, wherein a fluid is circulated between the evaporator and the at least one second heat exchanger in the cooling loop;

the evaporator comprising:

a shell comprising a first end and a second end;

a plurality of tubes disposed in the shell to circulate refrigerant from the refrigerant loop through the shell;

a plurality of shell inlets in fluid communication with the shell to deliver a fluid from the cooling loop to exchange heat with the refrigerant in the plurality of tubes, at least one other shell inlet being disposed adjacent to the first end and at least one shell inlet being disposed adjacent to the second end; and a shell outlet in fluid communication with the shell to discharge the fluid from the shell, the shell outlet being arranged and disposed to receive the combined fluid delivered to the shell by the plurality of shell inlets.

14. The system of claim 13, wherein the evaporator farther comprises:

a first header being arranged and disposed in fluid communication with the tubes, the first header being disposed adjacent to the first end; and a second header being arranged and disposed in fluid communication with the tubes, the second header being disposed adjacent to the second end.

15. The system of claim 14, wherein the first header, second header and the plurality of tubes are arranged to provide multiple refrigerant passes through the shell.

16. The system of claim 14, wherein the first header, second header and the plurality of tubes are arranged to allow heat exchange between the fluid and a plurality of refrigerant circuits.

17. The system of claim 13, wherein the fluid comprises a liquid selected from the group consisting of water, glycol, brine and combinations thereof.

18. The system of claim 13, wherein an evaporating temperature of the evaporator is substantially independent of a direction of refrigerant flow in the plurality of tubes.

19. The evaporator of claim 13, wherein a cooling capacity of the evaporator is substantially independent of a direction of refrigerant flow in the plurality of tubes.

20. The evaporator of claim 13, wherein a rate of heat exchange of the evaporator is substantially independent of a direction of refrigerant flow in the plurality of tubes.

21. The system of claim 13, wherein a ratio of a shell length to a shell inner diameter is greater than about 5:1.

22. The evaporator of claim 21, wherein the ratio of the shell length to the shell inner diameter is greater than about 7:1.

23. The system of claim 13, wherein the shell further comprises at least one baffle arranged and disposed to support the plurality of tube direct fluid flow over the plurality of tubes.

24. The system of claim 13, wherein the outlet is disposed substantially at a mid-point between the first end and the second end.

* * * * *